US009963336B2

(12) United States Patent
Degraaf, III et al.

(10) Patent No.: US 9,963,336 B2
(45) Date of Patent: May 8, 2018

(54) BUCKET FUNNEL

(71) Applicant: Martin Christian Degraaf, III, New Hartford, CT (US)

(72) Inventors: Martin Christian Degraaf, III, New Hartford, CT (US); Timothy Corcoran Repp, Barkhamsted, CT (US)

(73) Assignee: Martin Christian DeGraaf, III, New Hartford, CT (US)

( * ) Notice: Subject to any disclaimer, the term of this patent is extended or adjusted under 35 U.S.C. 154(b) by 0 days. days.

(21) Appl. No.: 15/504,363

(22) PCT Filed: Sep. 1, 2015

(86) PCT No.: PCT/US2015/047844
§ 371 (c)(1),
(2) Date: Feb. 16, 2017

(87) PCT Pub. No.: WO2016/036679
PCT Pub. Date: Mar. 10, 2016

(65) Prior Publication Data

US 2017/0240398 A1 Aug. 24, 2017

Related U.S. Application Data

(60) Provisional application No. 62/046,240, filed on Sep. 5, 2014.

(51) Int. Cl.
*B67C 11/02* (2006.01)
*B65D 25/48* (2006.01)
(Continued)

(52) U.S. Cl.
CPC ..... *B67C 11/02* (2013.01); *B65D 25/48* (2013.01); *B65D 25/50* (2013.01); *B65D 25/40* (2013.01);
(Continued)

(58) Field of Classification Search
CPC ..... B65D 25/40; B65D 25/42; B65D 25/48; B65D 25/50; B65D 23/006; B67C 11/00;
(Continued)

(56) References Cited

U.S. PATENT DOCUMENTS 200,120 A 2/1878 Atterbury
453,081 A * 5/1891 Heimbaugh ..... A47J 36/08 210/466
(Continued)

FOREIGN PATENT DOCUMENTS

KR 860000090 2/1986

OTHER PUBLICATIONS

Jong, Jae-Ung, English translation of KR860000090U Y1, Leak-proof fluidal injector, publication date Feb. 12, 1986.
(Continued)

*Primary Examiner* — Nicholas J Weiss
*Assistant Examiner* — Andrew P Bainbridge
(74) *Attorney, Agent, or Firm* — Mark Nowotarski

(57) ABSTRACT

A bucket funnel has a funnel body which clips onto a bucket with a top flange. The funnel body has a semicircular lower edge which has about the same radius of curvature as the bucket, but only extends about halfway around. There are outer tabs with inward facing channels at the ends of the lower edge of the funnel body to clip into the flange of the bucket. There is also a spring loaded release clip at about the middle of the lower edge to clip onto the outer flange of the bucket. An inner apron extends down from the lower edge of the funnel body to form a seal against the inner wall of the bucket. An interchangeable conical nozzle attaches to the funnel body for dispensing of fluids of various viscosities, such as glue, paint or fresh concrete.

20 Claims, 7 Drawing Sheets

(51) Int. Cl.

| | |
|---|---|
| ***B65D 25/50*** | (2006.01) |
| *B67C 11/04* | (2006.01) |
| *B65D 25/40* | (2006.01) |
| *B65D 25/42* | (2006.01) |
| *B67C 11/00* | (2006.01) |

(52) U.S. Cl.
CPC ..... *B65D 25/42* (2013.01); *B67C 11/00* (2013.01); *B67C 11/04* (2013.01)

(58) Field of Classification Search
CPC ..... B67C 11/02; B67C 11/04; B67C 11/06; B67C 11/063; B67C 11/066; B67C 2011/20; B67C 11/30; B67C 11/40; B67C 11/022; B67C 11/025; B67C 11/027
USPC ..... 222/460–461, 566–567, 570; 215/386, 215/391
See application file for complete search history.

(56) References Cited

U.S. PATENT DOCUMENTS

| | | | | | |
|---|---|---|---|---|---|
| 1,298,031 | A | * | 3/1919 | Fromhagen | B65D 25/48 222/569 |
| 1,587,934 | A | * | 6/1926 | Bartlett | A47J 36/14 141/338 |
| 2,200,642 | A | * | 5/1940 | Shell | B67C 11/02 222/460 |
| 2,520,549 | A | * | 8/1950 | Jacobsen | B65D 25/48 222/460 |
| 3,221,955 | A | | 12/1965 | Banaszak et al. | |
| 3,421,654 | A | | 1/1969 | Hexel | |
| 3,844,457 | A | | 10/1974 | Smart | |
| 3,853,249 | A | * | 12/1974 | Weir, Jr. | B65D 25/48 222/570 |
| 3,863,819 | A | * | 2/1975 | Storm | B65D 25/48 222/569 |
| 3,987,943 | A | | 10/1976 | Richmond, Jr. | |
| 4,129,236 | A | | 12/1978 | Wrycraft et al. | |
| 4,203,537 | A | | 5/1980 | McAlister | |
| 4,230,238 | A | * | 10/1980 | Wilson | G01F 19/00 141/98 |
| 4,239,130 | A | | 12/1980 | Altadonna | |
| 4,369,890 | A | | 1/1983 | Bennett | |
| 4,702,395 | A | * | 10/1987 | Nitsch | B44D 3/12 220/318 |
| 4,724,979 | A | | 2/1988 | Cleevely et al. | |
| 4,865,233 | A | | 9/1989 | Kain | |
| 4,911,319 | A | | 3/1990 | DeJean | |
| D309,109 | S | | 7/1990 | Allen | |
| 4,955,513 | A | | 9/1990 | Bennett | |
| 5,452,820 | A | | 9/1995 | Mislavsky | |
| 5,467,888 | A | | 11/1995 | Brandstrom et al. | |
| 5,505,347 | A | | 4/1996 | Roma | |
| 5,527,009 | A | | 6/1996 | Allen | |
| 5,579,963 | A | * | 12/1996 | Murthi | B44D 3/128 222/570 |
| 5,893,489 | A | | 4/1999 | Giarrante | |
| 6,264,072 | B1 | | 7/2001 | Johannes | |
| 6,851,584 | B2 | * | 2/2005 | White | B65D 23/106 222/475 |
| 7,000,808 | B2 | | 2/2006 | Schuessler | |
| 7,802,702 | B2 | * | 9/2010 | Archer, Jr. | B65D 25/40 210/466 |
| 8,820,557 | B2 | * | 9/2014 | Parks, Jr. | B65D 88/26 215/250 |
| 2008/0277418 | A1 | | 11/2008 | Vockler et al. | |
| 2013/0126562 | A1 | | 5/2013 | Feldmeier | |
| 2014/0144547 | A1 | | 5/2014 | Roseman | |
| 2014/0305972 | A1 | | 10/2014 | Dudik | |
| 2014/0331543 | A1 | | 11/2014 | Hancock | |
| 2015/0232233 | A1 | * | 8/2015 | Kent | B44D 3/128 222/570 |
| 2017/0240398 | A1 | * | 8/2017 | DeGraaf, 3rd | B67C 11/02 |

OTHER PUBLICATIONS

Allway Tools CPS 1 Gallon Deluxe Pouring Spout and Can Cover, https://www.amazon.com/Allway-CPS-Gallon-Deluxe-Pouring/dp/B00316W1RI/, Jul. 23, 2014.
Yoha 5-Gal. Pour Spout, http://www.homedepot.com/p/YOHA-5-Gal-Pour-Spout-300/100544985, Jul. 23, 2014.
PIG® 5-Gallon Latching Pail Lid, Jul. 6, 2015.
Motor Sports Newswire, New Product Press Release from Pit Posse! dated Aug. 16, 2011, https://motorsportsnewswire.com/2011/08/16/new-product-press-release-from-pit-posse-0816112/, Jul. 23, 2014.
International Search Report for PCT/US2015/047844, dated Nov. 24, 2015.
Written Opinion of the International Searching Authority for PCT/US2015/047844, dated Nov. 24, 2015.
LabelMaster, Pail Tippers, http://www.labelmaster.com/shop/un-packaging/jerricans-pails/pail-tippers/, Jul. 25, 2014.
Paint Can Pour Spouts Fits Gallon Guart and Pint Flexi Plastic 5 Pieceson ebay.com, Jul. 23, 2014.
Shur-Line 06100 Gallon Can Paint Pourer on amazon.com, Jul. 23, 2014.
Fas-Trak Industries, Sting-Ray Direct Dispense Applicator, Jul. 25, 2014.

* cited by examiner

BUCKET FUNNEL

TECHNICAL FIELD

The inventions described herein are in the field of dispensing nozzles.

BACKGROUND ART

There is a long felt need for an effective way to transfer liquids from containers. FIG. 1 illustrates side view of a prior art pouring spout system 100. The system comprises a pouring spout 110 fitted into the top of a paint can 102. An example of this system is the Allway® "Spout and Can Cover". The pouring spout comprises a lower tapered circular skirt 112 and an upper rim 114. One end of the rim comprises a wide lip 116. The circular tapered skirt is wedged into the internal gutter 104 of the paint can to form a seal. The skirt may be made of plastic. If the paint can is tipped at an angle 124, the paint 106 within the can flows onto the rim, overflows the lip and descends as a stream 132.

This system is effective for transferring runny fluids from a can to another container. The system is not effective, however, if one wishes to transfer a more viscous fluid, such as caulking, from a container to a surface below as a continuous steady stream of material. The rate of flow in the descending stream from an Allway system is highly variable. Small changes in the tipping angle cause significant changes 125 in the head 122 of the poured liquid. This causes large changes in flow rate due to the wide open top lip. The variable flow rate 136 causes the deposited bead of the fluid 134 to sometimes be high and wide 128 or low and narrow 126. The wide open top lip also allows the stream to swing from side to side. There is need, therefore, for a system to transfer liquids from a container to a surface below that provides a uniform steady well-directed flow of material.

DISCLOSURE OF INVENTION

The disclosure of the invention is a guide to understanding the invention. It does not necessarily describe the most generic embodiment.

FIG. 2 illustrated a bucket funnel system 200 that comprises a bucket funnel 210 mounted on a bucket 202. As used herein, "bucket", may mean any open top container. An exemplary bucket might be a 5 liter bucket or 20 liter bucket. Twenty liter buckets are known as "5 gallon buckets". The bucket funnel comprises a conical nozzle 214 attached to a funnel body 220. The attachment may be by means of a threaded collar 212.

The funnel body comprises a semicircular lower edge 264 with about the same radius of curvature as the rim 201 of the bucket. A funnel rim 222 is upward of the lower edge. The funnel rim and lower edge form an inlet opening to the funnel body. The funnel body converges outwardly to form a hopper 262. The hopper ends in a hopper opening 268 at its apex 266. The hopper opening may be threaded and circular to accept the threaded collar 212.

The funnel body is attached to the bucket using a combination of outer tabs 226 to engage an outer flange 204 of the bucket, an inner apron 228 to form a liquid tight seal with the inner wall 203 of the bucket, and a release clip 230 to snap onto said outer flange of the bucket. The outer tabs are located at the ends of the lower edge of the funnel body. Each outer tab comprises an inward facing channel 265 which fits over the outer flange of the bucket. The inner apron comprises a back plate 227 and a flexible skirt 229 extending outward from said back plate. The release clip is mounted on the lower edge of the funnel body with a spring loaded hinge 232. The release clip comprises a handle 236 that extends downward from the hinge. The handle has an inward facing notch 234 and optional inner tapered wall 237.

In operation, the funnel body is placed on the bucket with the channels of the outer tabs engaging the bucket flange. The funnel body is then pressed down. The tapered wall of the release clip is pushed open by the outer flange of the bucket until the notch is reached at which point the release clip snaps closed. The flexible skirt presses against the inner wall of the bucket to form a seal. For removal of the funnel body, the handle of the release clip is pulled forward to disengage the notch from the outer flange of the bucket and the funnel body is lifted off.

Any number of nozzle configurations may be used with a given funnel body depending upon the application. The nozzles may vary in opening size from very small (e.g. 1 mm) to very large (e.g. 10 cm) depending upon the viscosity of the fluid being dispensed and the application. In operation, a user selects an appropriate nozzle with an appropriate nozzle opening 215. The nozzle opening may be described by a nozzle diameter 244. The nozzle opening can be any shape including multiple holes. When the bucket is inclined at a tipping angle 240, fluid 206 in the bucket flows into the funnel body and into the nozzle. The rate of flow out of the nozzle is determined by the properties of the fluid (e.g. viscosity), the configuration of the nozzle, the nozzle opening geometry and the head (i.e. hydrostatic pressure) 242 developed in the bucket funnel. Because of the funnel configuration, the flow rate of fluid from the nozzle 252 is relatively stable with respect to changes in the head 243. Thus the bead of fluid that is deposited on the surface below is relatively uniform 254, 256. The location of the bead is also well controlled due to the fixed opening in the nozzle as opposed to the wide and open top lip of the prior art pouring spout.

BEST MODE FOR CARRYING OUT THE INVENTION

The best mode for carrying out the invention describes non-limiting exemplary embodiments. Any individual features may be combined with other features as required by different applications for at least the benefits described herein. As used herein, the term "about" means plus or minus 10% of a given value unless specifically indicated otherwise.

Figure 1:
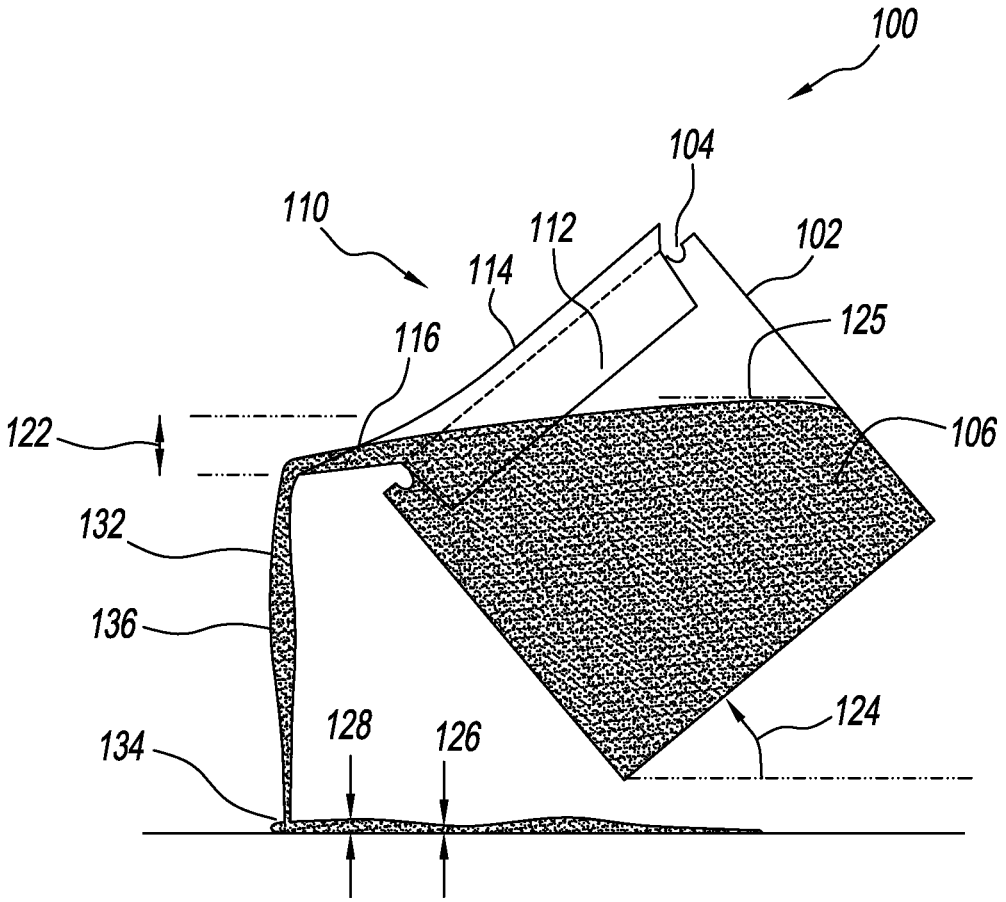
FIG. 1 (Prior art)
FIG. 1 is a side view of a prior art pouring spout system in operation.
Figure 2:
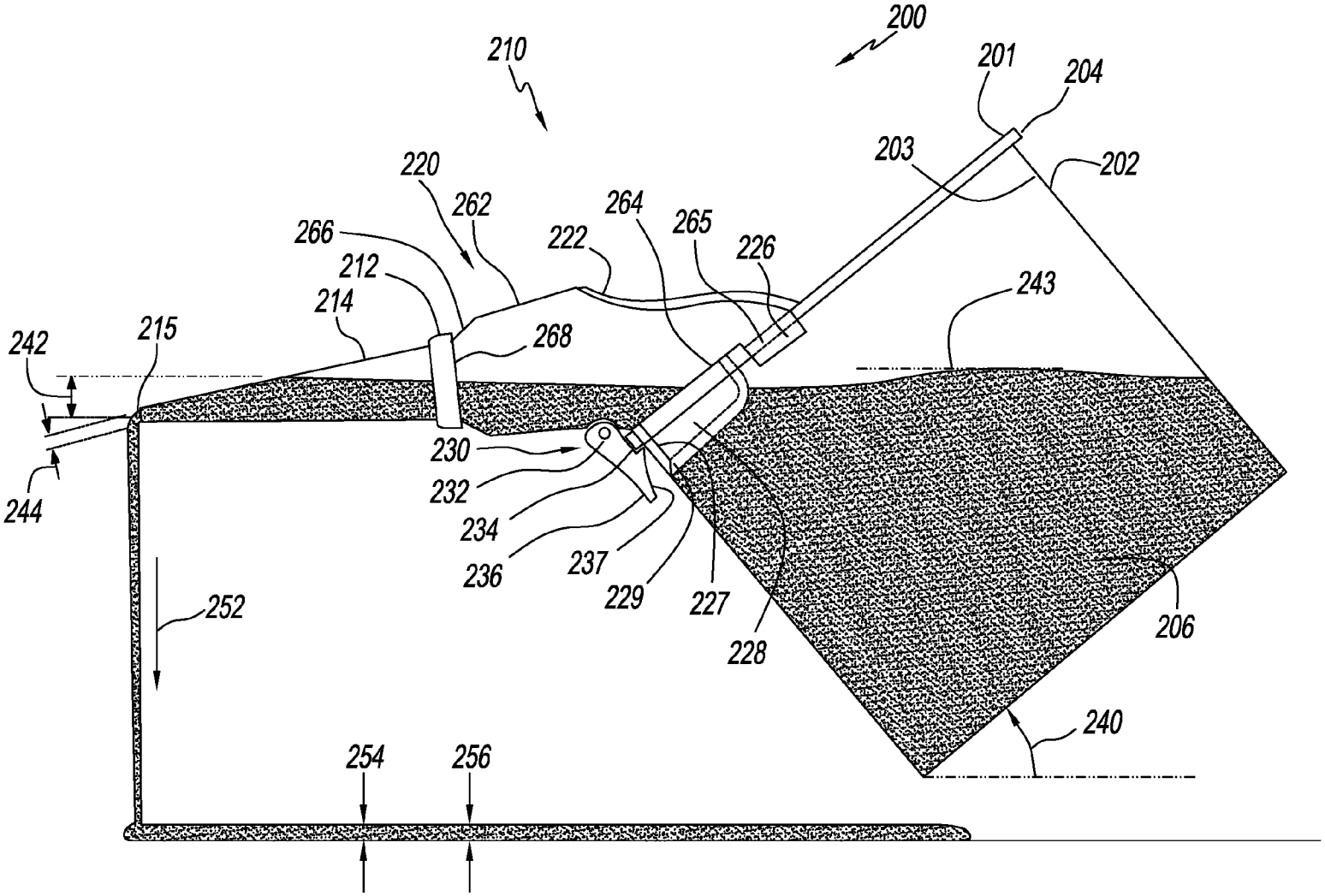
FIG. 2 is a side view of a bucket funnel system in operation.
Figure 3B:
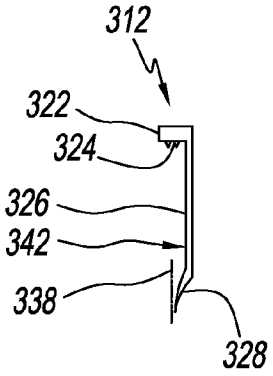
FIG. 3B is a cross section of an inner apron of a funnel body.
Figure 3A:
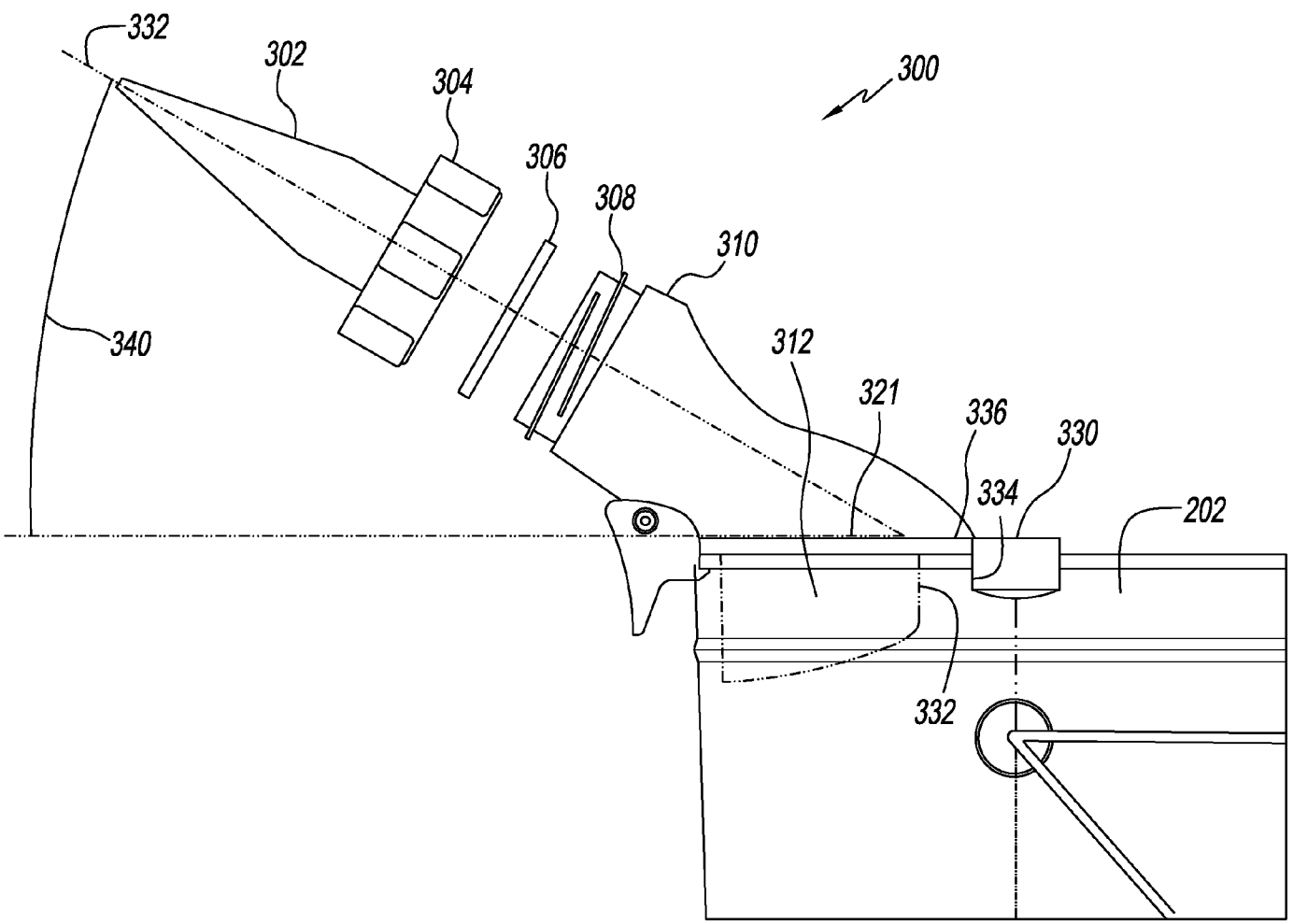
FIG. 3A is an exploded side view of an alternative bucket funnel.

FIG. 3A is an exploded side view of an alternative bucket funnel 300 mounted on a bucket 202 (shown in partial view). The illustrated nozzle 302 is from an Albion® caulking gun system. The nozzle is mounted on the funnel body 310 using a threaded collar 304 which engages a threaded hopper opening 308 extending from the funnel body. The nozzle is sealed to the hopper opening with an elastomeric O ring 306.

The nozzle has an axis 332. The axis may be inclined at an angle 340 with respect to the lower edge of the funnel body 321. The inclination angle may be in the range of 20 degrees to 60 degrees. A suitable inclination angle is about 30 degrees.

An inner apron 312 extends downward from the funnel body. An outer tab 330 is on each end of the lower edge. The forward vertical edge 334 of an outer tab is backward of the proximate backward vertical edge 332 of the inner apron. Thus there is a flexible arm 336 attaching each outer tab to the funnel body. This allows the outer tabs to be flexed out when installing or removing the bucket funnel on a bucket.

FIG. 3B shows a cross section of the inner apron 312. The inner apron comprises an apron rim 322 with an apron rim gasket 324 depending underneath. The inner apron further comprises a back plate 326 extending downward from the inner edge of the apron rim. A flexible skirt 328 is attached to the back plate. The flexible skirt is directed outward. This forms a flexible skirt standoff 338 between the outer wall 342 of the back plate and the inner wall of the bucket when the bucket funnel is installed. A suitable standoff is in the range of 1 to 10 mm. When the funnel body is placed on the bucket, the gasket forms a seal with the rim of the bucket and the flexible skirt forms a seal with the inner wall of the bucket. A surprising advantage of the flexible skirt in combination with the standoff of the back plate of the apron from the inner wall of the bucket is that an adequately tight seal can be formed with the inner wall of the bucket even if a certain amount of solid deposits are on the inner wall of the bucket. The deposits could be solidified paint, glue, concrete, etc. The standoff gives clearance to the deposits and the flexible edge conforms to variations in the deposits' thicknesses.

The bucket funnel can be made of appropriate materials, such as molded plastic, metals and elastomers. The plastics should be compatible with the materials that will be dispensed from the bucket. The materials that might be dispensed may include glues, sealants, fresh concrete and dry powders (e.g. sand).

Figure 4:
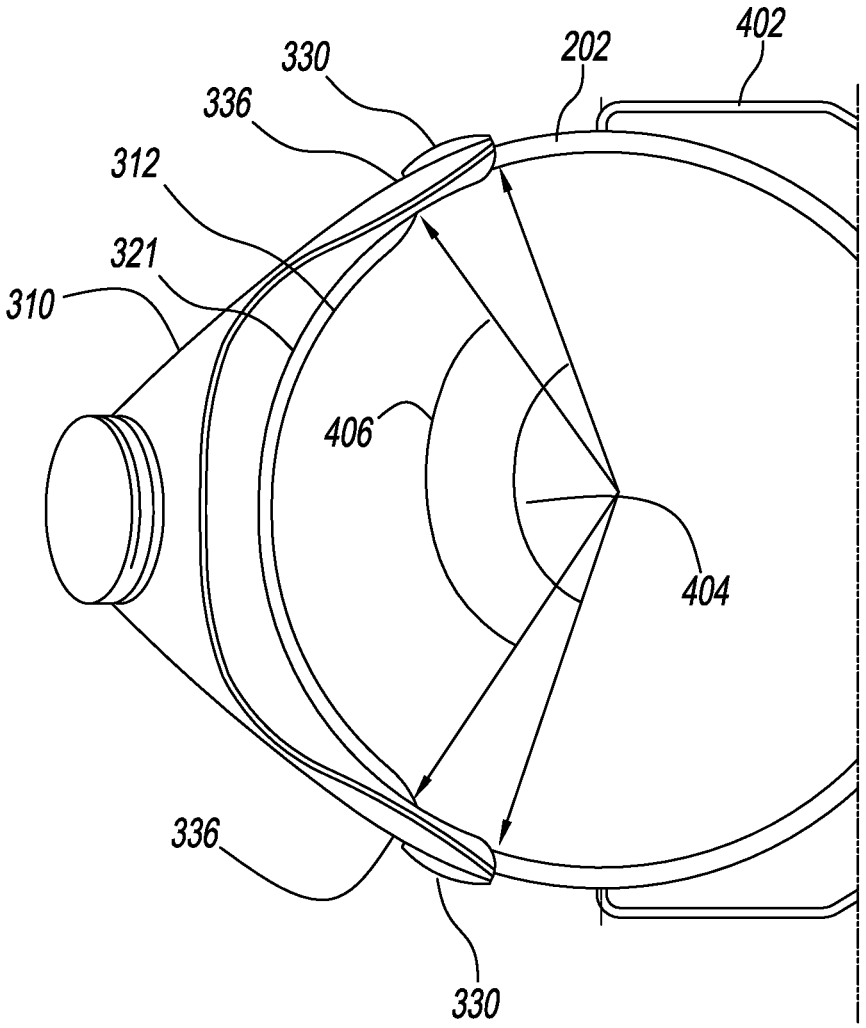
FIG. 4 is a top view of the alternative bucket funnel system of FIG. 3A.

FIG. 4 is a top view of the funnel body 310 of FIG. 3 mounted on bucket 202. The bucket comprises a handle 402. The semicircular lower edge of the funnel body 321 spans a rim angle 404 of about 180 degrees or less. This allows easy installation and removal. The rim angle should be large enough so that the fluid in the bucket will be captured in the funnel body when the bucket is tipped. A rim angle as small as 120 degrees is suitable. A rim angle of about 145 degrees is suitable. The inner apron 312 has a semicircular shape when viewed from above. The semicircular shape of the inner apron spans an apron angle 406 that is less than the rim angle. The apron angle should be large enough so that the skirt on the apron will keep fluid from flowing out underneath the flexible arms 336 attached to the outer tabs 330. An apron angle as low as 90 degrees is suitable. An apron angle of about 110 degrees is suitable.

Figure 5:
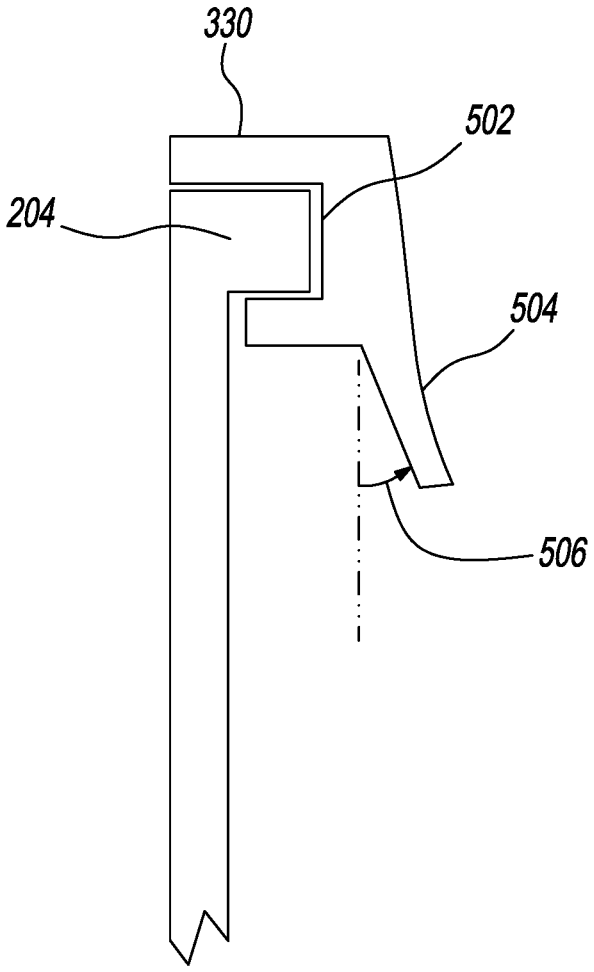
FIG. 5 is a cross section of an outer tab of a bucket funnel engaged with the outer flange of a bucket.

FIG. 5 is a cross section of an outer tab 330 of FIG. 3 mounted on the outer flange 204 of a bucket. The outer tab comprises an inward facing tab channel 502 that is dimensioned to fit around the outer flange of the bucket. The outer tab also comprises a tab handle 504 for pulling the tab away from the outer flange when installing or removing the bucket funnel on a bucket. The outer tab handle may be inclined down and outward at a flare angle 506. A suitable flare angle is in the range of 0 to 60 degrees.

Example 1

Figure 6:
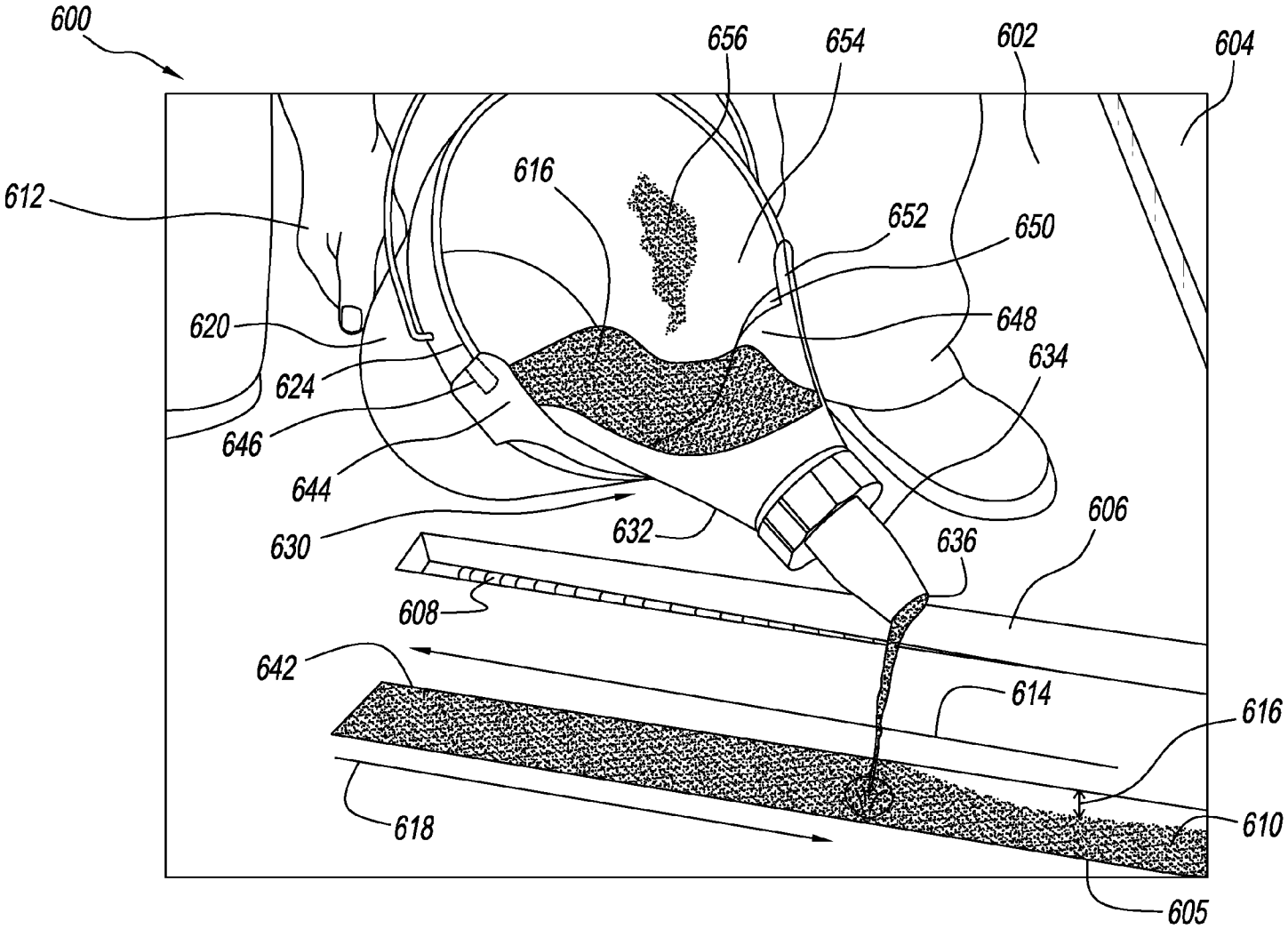
FIG. 6 is an illustration of a worker filling a first channel with fresh concrete poured from a bucket funnel system.
Figure 7:
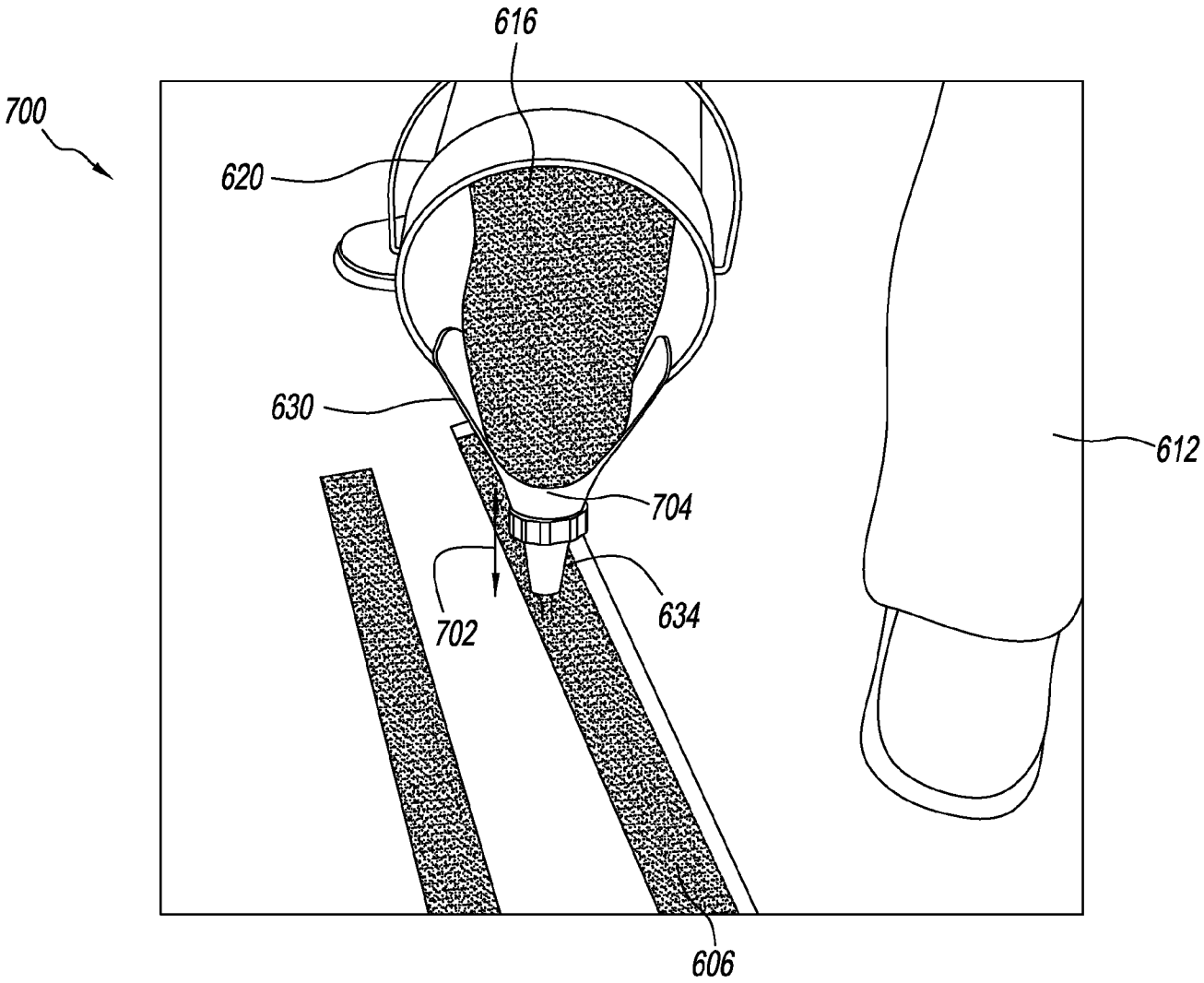
FIG. 7 is an illustration of the same worker as FIG. 6 filling a second channel with fresh concrete using the bucket funnel system.

FIGS. 6 and 7 are illustrations 600, 700 of a worker 612 pouring fresh concrete 616 from a 5 liter bucket 620 through an alternative embodiment of a bucket funnel 630. In FIG. 6, the worker has just interrupted filling a first channel 605 cut in a first concrete slab 602. The worker is joining the first concrete slab to a second concrete slab 604. The first channel is cut from the first slab to the second slab. A second channel 606 is similarly cut from the first slab to the second slab. A steel bar 608 which traverses the slabs has been placed in each of the channels. Fresh concrete is being poured 610 into each channel to lock in the steel bars thus joining the slabs together.

The bucket funnel comprises a nozzle 634 mounted on a funnel body 632. An inner apron 648 extends down from the funnel body. A flexible skirt 650 extends outward from the inner apron to press against and form a seal with the inner wall 654 of the bucket. The flexible skirt forms a seal despite the presence of deposits 656 of partially hardened concrete on the inner wall. The outer tabs of the funnel 646 engage the outer flange of the bucket 624. The outer tab 646 is shown as a dotted line. The outer tab is connected to the funnel body by a flexible arm 644. A reinforcing bar 652 has been added to each flexible arm for extra strength. The release clip is not visible in this view, but engages the outer flange of the bucket underneath the nozzle 634. The nozzle has a relatively wide opening 636 of about 3 cm to allow a controlled amount of fresh concrete to flow therethrough when the bucket is tipped over.

The worker has already made a first pass 614 of pouring concrete into the first channel 605. After the first pass, there was about 1 cm of clearance 616 between the top of the fresh concrete and the top of the channel. The worker then began a second pass 618 to finish filling the channel to its top edge 642. The worker has just tipped the bucket back to stop the flow of fresh concrete.

Referring to FIG. 7, the bucket 620 is tipped forward so that the bucket funnel 630 and nozzle 634 are pointing down. The worker 612 is in the process of filling the second channel 606 with fresh concrete 616. The fresh concrete is flowing into the bucket funnel at about the rate it is flowing out of the nozzle thus forming a stable head 702 and hence steady flow. The worker adjusted the tipping angle of the bucket to keep the head below the rim 704 of the bucket funnel.

CONCLUSION

While the disclosure has been described with reference to one or more different exemplary embodiments, it will be understood by those skilled in the art that various changes may be made and equivalents may be substituted for elements thereof without departing from the scope of the disclosure. In addition, many modifications may be made to adapt to a particular situation without departing from the essential scope or teachings thereof. Therefore, it is intended that the disclosure not be limited to the particular embodiment disclosed as the best mode contemplated for carrying out this invention.

We claim:

1. A bucket funnel comprising a funnel body, said funnel body comprising:

a) a semicircular lower edge;

b) a funnel rim above said lower edge;

c) a converging hopper extending outward of said funnel rim and said lower edge, said converging hopper comprising a hopper opening at its apex;

d) a first outer tab at a first end of said lower edge, said outer tab comprising an inward facing channel;

e) a second outer tab at a second end of said lower edge comprising an inward facing channel;

f) an inner apron extending down from said lower edge, said inner apron comprising:

i. a back plate; and ii. a flexible skirt at the bottom of said back plate, said flexible skirt extending in the direction of said opening of said hopper; and g) a release clip attached to about the midpoint of said lower edge, said release clip comprising:

i. a spring hinge attaching said release clip to said lower edge; and ii. a handle extending downward from said spring hinge, said handle comprising a notch facing towards said inner apron and away from said opening of said converging hopper such that said release clip will secure said bucket funnel to a rim of a bucket when said inner apron is inside of said bucket and said release clip is outside of said bucket.

2. The bucket funnel of claim 1 which further comprises a conical nozzle, said conical nozzle being adapted to attach to said opening in said funnel body and wherein said conical nozzle comprises a nozzle opening.

3. The bucket funnel of claim 2 wherein said opening of said hopper comprises a thread and wherein said nozzle is held onto said funnel body by a threaded collar that engages said thread on said opening of said hopper.

4. The bucket funnel of claim 2 wherein the axis of said conical nozzle is inclined at an angle with respect to said lower edge of said funnel body, said inclination angle being in the range of 20 to 60 degrees.

5. The bucket funnel of claim 1 wherein said first outer tab is attached to said first end of said funnel body by a first flexible arm and said second outer tab is attached to said second end of said funnel body by a second flexible arm.

6. The bucket funnel of claim 1 wherein said first outer tab comprises a first forward vertical edge and said inner apron comprises a first backward vertical edge and wherein said first forward vertical edge of said first outer tab is proximate to and back from said first backward vertical edge of said inner apron.

7. The bucket funnel of claim 1 wherein said semicircular lower edge of said funnel body spans a rim angle in the range of 120 to 180 degrees.

8. The bucket funnel of claim 7 wherein said inner apron has a semicircular cross section when viewed from above and wherein said semicircular cross section spans an apron angle in the range of 90 degrees up to said rim angle.

9. The bucket funnel of claim 1 wherein said first outer tab comprises a tab handle extending downward therefrom.

10. A bucket funnel comprising a funnel body, said funnel body comprising:

a) a semicircular lower edge;

b) a funnel rim above said lower edge;

c) a converging hopper extending outward of said funnel rim and said lower edge, said converging hopper comprising a hopper opening at its apex;

d) an inner apron extending down from said lower edge, said inner apron comprising:

i. a back plate; and ii. a flexible skirt at the bottom of said back plate, said flexible skirt extending toward said opening of said hopper; and e) a release clip attached to about the midpoint of said lower edge, said release clip comprising:

i. a spring hinge attaching said release clip to said lower edge; and ii. a handle extending downward from said spring hinge, said handle comprising a notch facing towards said inner apron and away from said opening of said hopper such that said release clip will secure said bucket funnel to a rim of a bucket when said inner apron is inside of said bucket and said release clip is outside of said bucket.

11. The bucket funnel of claim 10 wherein said opening of said hopper comprises a thread adapted to secure a threaded collar of a nozzle thereto.

12. A method for dispensing a flowable material from a bucket as a continuous uniform stream, said method comprising the steps of:

a) securing a bucket funnel to a rim of said bucket, said bucket funnel comprising:

i. a semicircular lower edge;

ii. a funnel rim above said lower edge;

iii. a converging hopper extending outward of said funnel rim and said lower edge, said converging hopper comprising an inlet opening and a hopper opening at an apex of said converging hopper;

iv. a nozzle attached to said hopper opening, said nozzle having an axis inclined at an angle of 20 to 60 degrees with respect to said rim of said bucket when said bucket funnel is secured to said rim of said bucket;

v. an inner apron extending downward from said lower edge, said inner apron being adapted to form a liquid tight seal with an inner wall of said bucket when said bucket funnel is secured to said rim; and vi. a release clip attached to about the midpoint of said lower edge, said release clip comprising:

1. a spring hinge attaching said release clip to said lower edge; and 2. a handle extending downward from said spring hinge, said handle comprising a notch facing towards said inner apron and away from said hopper opening such that said release clip will secure said bucket funnel to the rim of said bucket when said inner apron is inside of said bucket and said release clip is outside of said bucket; and b) tipping said bucket at a tipping angle such that said flowable material flows over said inner apron, into said converging hopper and fills at least a portion of said nozzle such that said flowable material flows out of said nozzle as said continuous uniform stream.

13. The method of claim 12 wherein said flowable material is one of a glue, a sealant, a fresh concrete or a dry powder.

14. The method of claim 12 wherein said inner apron has a semicircular shape when viewed from above and wherein said semicircular shape spans an apron angle in the range of 90 degrees to 180 degrees.

15. The method of claim 12 wherein said inner apron and said funnel body are an integral unit.

16. The method of claim 12 wherein said bucket is a 5 liter bucket, said rim of said bucket comprises an outer flange, and said bucket funnel is adapted to engage said outer flange.

17. The method of claim 12 wherein:

a) said inner apron comprises a back plate and a flexible skirt; and b) said back plate is configured to form a standoff with respect to said inner wall of said bucket when said flexible skirt presses against said inner wall of said bucket to form said liquid tight seal such that said liquid tight seal will be formed even if there are solidified deposits on said inner wall of said bucket.

18. The method of claim 17 wherein said standoff is in the range of 1 to 10 mm.

19. The method of claim 12 wherein said bucket comprise a handle and said step of tipping said bucket is done by hand.

20. The method of claim 12 wherein said continuous uniform stream of flowable material is dispensed onto a flat surface.

* * * * *